US007880603B2

(12) United States Patent
DiPoala

(10) Patent No.: US 7,880,603 B2
(45) Date of Patent: Feb. 1, 2011

(54) SYSTEM AND METHOD FOR CONTROLLING AN ANTI-MASKING SYSTEM

(75) Inventor: William S. DiPoala, Fairport, NY (US)

(73) Assignee: Robert Bosch GmbH, Stuttgart (DE)

( * ) Notice: Subject to any disclaimer, the term of this patent is extended or adjusted under 35 U.S.C. 154(b) by 708 days.

(21) Appl. No.: 11/539,649

(22) Filed: Oct. 9, 2006

(65) Prior Publication Data

US 2008/0084292 A1 Apr. 10, 2008

(51) Int. Cl.
*G08B 29/00* (2006.01)
*G08B 13/00* (2006.01)

(52) U.S. Cl. ..... 340/506; 540/565

(58) Field of Classification Search ..... 340/565, 340/506

See application file for complete search history.

(56) References Cited

U.S. PATENT DOCUMENTS 4,437,089 A * 3/1984 Achard ..... 340/541
4,636,744 A 1/1987 King et al.
4,746,910 A 5/1988 Pfister et al.
4,833,450 A * 5/1989 Buccola et al. ..... 340/506
4,882,567 A * 11/1989 Johnson ..... 340/522
5,276,427 A * 1/1994 Peterson ..... 340/522
5,287,111 A 2/1994 Shpater
5,317,304 A 5/1994 Choi
5,331,308 A * 7/1994 Buccola et al. ..... 340/522
5,504,473 A 4/1996 Cecic et al.
5,578,988 A * 11/1996 Hoseit et al. ..... 340/522
5,831,529 A 11/1998 Pantus
6,262,661 B1 * 7/2001 Mahler et al. ..... 340/567
6,351,234 B1 2/2002 Choy
6,377,174 B1 4/2002 Siegwart et al.
6,380,882 B1 4/2002 Hegnauer
2005/0030180 A1 2/2005 Pantus et al.
2005/0141345 A1 6/2005 Holm et al.

* cited by examiner

*Primary Examiner*—Daniel Wu
*Assistant Examiner*—John F Mortell
(74) *Attorney, Agent, or Firm*—Baker & Daniels LLP

(57) ABSTRACT

The present invention is directed to a method and system for controlling operation of an anti-masking system that detects tampering with a motion detection system. The control system may include a selective adjustment mechanism for adjusting a sensitivity level of the anti-masking system and a trigger mechanism for triggering the selective adjustment mechanism upon occurrence of an event to raise the sensitivity level of the anti-masking system. The control system may additionally include a timer for extending the raised sensitivity level for a predetermined time period beyond the occurrence of the event. The control system may operate in conjunction with a motion detection system that includes at least one motion detection sensor for detecting motion.

24 Claims, 6 Drawing Sheets

SYSTEM AND METHOD FOR CONTROLLING AN ANTI-MASKING SYSTEM

TECHNICAL FIELD

Embodiments of the present invention relate to security systems. More particularly, embodiments of the invention are directed to controlling an anti-masking system that detects tampering with motion detection components of the security system.

BACKGROUND OF THE INVENTION

Currently, in the field of security systems, motion detection components are generally provided to detect intruders. Intruders may attempt to sabotage or tamper with the motion detection components through various techniques. For example, intruders may attempt to mask detectors by coating them with an opaque substance that acts as a barrier between a motion detection sensor and the corresponding monitored space. Alternatively, intruders may attempt to cover the entire motion detector with an object or otherwise tamper with the motion detection components. Accordingly, security systems having motion detection components are often equipped with an anti-masking system that detects tampering with the motion detection components.

One example of such a system is disclosed in U.S. Patent Application Publication US 2005/0141345, which discloses a method and system for monitoring objects having chips attached. The chips transmit ultrasound signals and include a sabotage sensor 110, a motion detector 130, and a timer 120. The sabotage sensor 110 is activated if removed from the object to which it was attached.

U.S. Pat. No. 4,636,774 discloses a light control system including a variable sensitivity motion detector. When initial entry motion is detected, the system turns on the lights and increases sensitivity to detect continued presence within a room. The increased sensitivity is maintained for a specified period of time while the lights are on. After a period without motion detection, the system extinguishes the lights and sensitivity is reset to a lower value.

U.S. Pat. No. 6,351,234 shows a combination passive microwave and infrared motion detector with anti-masking evaluation. The detector samples sensor signals and compares the signals to a series of possible outcomes. Some of the possible outcomes represent masking conditions. When a person approaches the sensor and is within a predetermined distance of the sensor, the system will automatically initiate an anti-masking algorithm.

Currently available anti-masking systems may generate false alarms if they are too sensitive, as they may be triggered by background noise sources such as insects or birds even when no intruder is present. In some cases, anti-masking systems may generate a false alarm due to external infrared (IR) light sources, IR remote controls, fluorescent lights, or PDAs. Some attempts have been made to reduce the false alarm rate of anti-masking systems.

For example, U.S. Pat. No. 6,380,882 discloses a motion detector that includes a sabotage monitoring device. The motion detector also includes distance independent suppression of signals triggered by small animals and insects to reduce the false alarm rate of the motion detection system.

However, a further need exists to reduce false alarms while simultaneously increasing sensitivity of the anti-masking device when an intruder is present in the monitoring area.

BRIEF SUMMARY OF THE INVENTION

In one aspect, an anti-masking control system may be provided for controlling operation of an anti-masking system that detects tampering with a motion detection system. The control system may include a selective adjustment mechanism for adjusting a sensitivity level of the anti-masking system. The control system may additionally include a trigger mechanism for triggering the selective adjustment mechanism upon occurrence of an event to raise the sensitivity level of the anti-masking system.

In an additional aspect, a motion detection system may be provided that includes at least one motion detection sensor for detecting motion and an anti-masking system for preventing tampering with the motion detection sensor. The motion detection system may additionally include an anti-masking control system for minimizing false alarms of the anti-masking system by selectively altering a sensitivity of the anti-masking system.

In an additional aspect, a method may be provided for minimizing false alarms in an anti-masking system designed to prevent tampering with a motion detection system. The method may include implementing a sensor to detect intruder presence and activating a trigger mechanism upon detection of the intruder presence. The method may additionally include selectively adjusting a sensitivity level of the anti-masking system in response to the detection of the intruder presence.

BRIEF DESCRIPTION OF THE DRAWINGS

The present invention is described in detail below with reference to the attached drawings figures, wherein.

DETAILED DESCRIPTION OF PREFERRED EMBODIMENTS

Embodiments of the present invention are directed to a system and method for controlling an anti-masking system that operates to prevent tampering with a motion detection system. The motion detection system may typically be incorporated in a security system.

Figure 1:
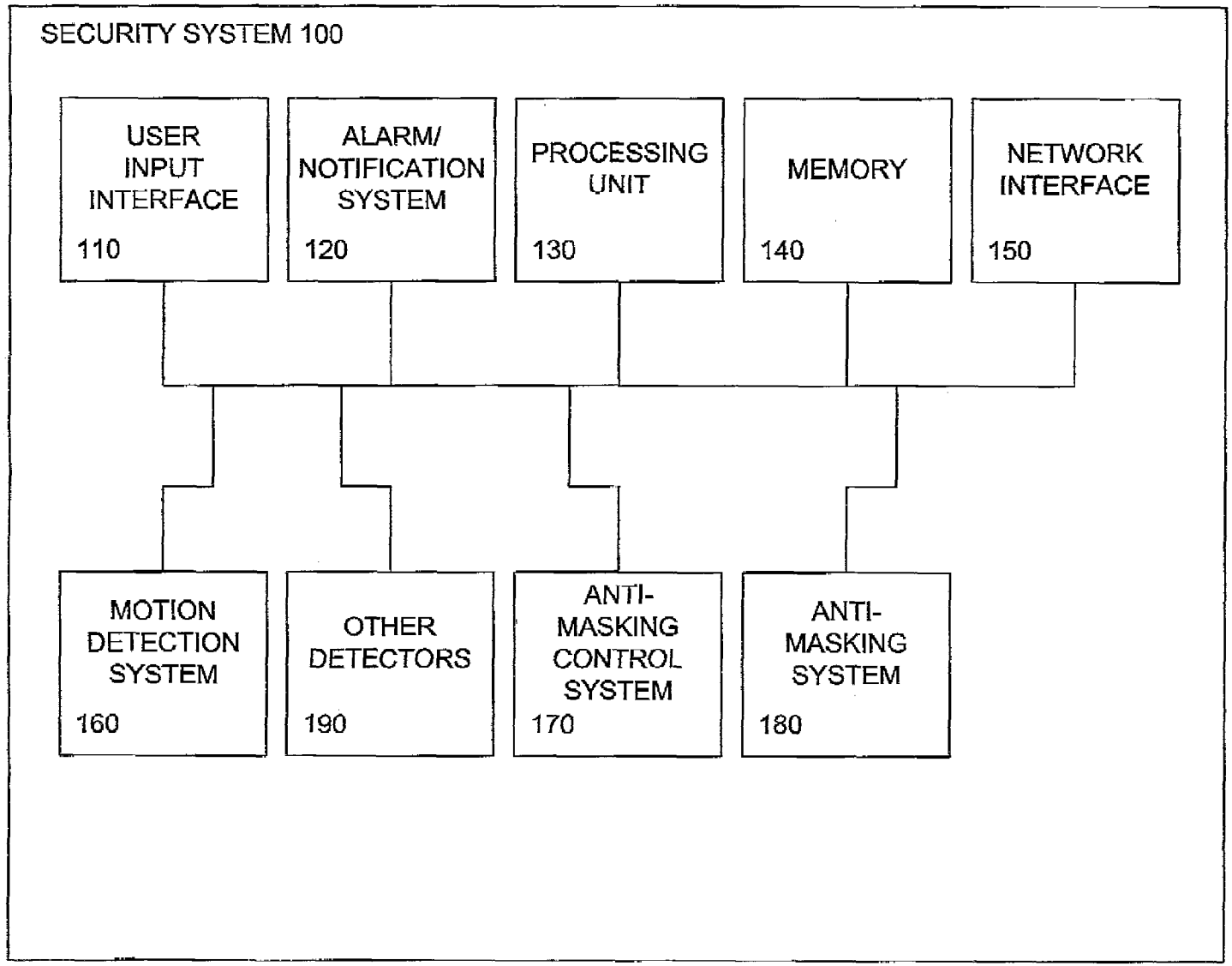
FIG. 1 is a block diagram illustrating components of a security system environment in accordance with an embodiment of the invention.

FIG. 1 is a block diagram illustrating components of a security system environment in accordance with an embodiment of the invention. In the illustrated system, a security system 100 may include a user input interface 110, alarm and notification systems 120, a processing unit 130, a memory 140, and a network interface 150. The security system 100 may also include a motion detection system 160, an anti-masking control system 170, an anti-masking system 180, and other detectors 190. The components of the motion detection system 160, along with the anti-masking control system 170 and the anti-masking system 180 may operate so as to ensure detection, prevent tampering, and minimize false alarms related to tampering. All of the aforementioned components may be linked by a system bus or other appropriate mechanism or mechanisms. The other detectors 190 may include smoke detectors, vibration detectors, or other detectors useful for a security system.

With regard to the user input interface 110, a user may enter commands and information using input devices such as a keyboard and pointing device, commonly referred to as a mouse, trackball or touch pad. Other input devices may include a microphone, satellite dish, scanner, or the like. These and other input devices are often connected to the processing unit 130 through the user input interface 110 that is coupled to the system bus, but may be connected by other interface and bus structures, such as a parallel port or a universal serial bus (USB). A monitor or other type of display device and other peripherals may also be connected to the system bus via an interface.

The alarm/notification system 120 may be operable to trigger an alarm upon detecting a security violation. The security violation may be detected by the detectors 160 or 190, which subsequently send a signal to the alarm/notification system 120. The alarm/notification system 120 may activate any appropriate type of visible or audible alarm including both remote and proximal alarms.

The system memory 140 may include computer storage media in the form of volatile and/or nonvolatile memory such as read only memory (ROM) and random access memory (RAM). A basic input/output system (BIOS), containing the basic routines that help to transfer information between elements within the security system environment 100, such as during start-up, is typically stored in ROM. RAM typically contains data and/or program modules that are immediately accessible to and/or presently being operated on by processing unit 130.

The RAM may include an operating system, program data, and application program. The application programs may be described in the general context of computer-executable instructions, such as program modules, being executed by a computer. Generally, program modules include routines, programs, objects, components, data structures, etc. that perform particular tasks or implement particular abstract data types. Moreover, those skilled in the art will appreciate that the invention may be practiced with other computer system configurations, including multiprocessor systems, microprocessor-based or programmable consumer electronics, minicomputers, mainframe computers, and the like.

The security system environment 100 may also include other removable/non-removable, volatile/nonvolatile computer storage media. A hard disk drive may be provided that reads from or writes to non-removable, nonvolatile magnetic media, a magnetic disk drive that reads from or writes to a removable, nonvolatile magnetic disk, and an optical disk drive that reads from or writes to a removable, nonvolatile optical disk such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive is typically connected to the system bus through a non-removable memory interface. The magnetic disk drive and optical disk drive are typically connected to the system bus by a removable memory interface.

Although FIG. 1 shows only one network interface module 150, more than one network interface module 150 may be present and connected to a router, switch or hub. The security system 100 in embodiments of the present invention may operate in a networked environment using logical connections to communicate with networked components. Logical connections for networking may include a local area network (LAN) or a wide area network (WAN), but may also include other networks. When used in a LAN networking environment, the system may be connected to the LAN through the network interface 150 or adapter.

The detectors 190 may include any type of detectors suitable for implementation in a security system. For example, the detectors may include smoke detectors, vibration detectors or any other types of detectors. The detectors 190 may be wirelessly connected or hardwired to the security system 100.

The detector or detectors of the motion detection system 160 may include a passive infra red (PIR) motion detector. The motion detection system 160 could include a dual detector using both PIR and microwave (MW) technologies. An example of such a dual detector is disclosed in U.S. Pat. No. 7,034,675, which is incorporated herein by reference. The detection system using the PIR and or MW detectors may identify when an intruder is present and activate or wake up the anti-masking system 180 through the use of the anti-masking control system 170, which will be further described herein with reference to FIGS. 2 and 3.

The anti-masking system 180 may include an active IR detector capable of detecting objects within a short distance, for example, such as less than three feet or anywhere from one inch to five feet. The anti-masking system 180 could also include a short range MW detector.

Since the anti-masking system 180 could be triggered falsely as a result of background noise sources such as birds, bugs, radio frequency interference, IR light sources, fluorescent lights, PDAs, etc, the anti-masking control system 170 is provided to reduce the incidence of false alarms. The anti-masking control system 170 serves to disable or desensitize the anti-masking system when no human presence is detected in the vicinity of the motion detectors. Conversely, the anti-masking control system 170 operates to extend heightened sensitivity and/or an enabled state of the anti-masking system 180 when the likelihood of tampering is elevated due to human presence. The anti-masking control system 170 may activate a timer for extending a sensitivity level or operative mode of the anti-masking system 180 after a human presence is detected in the vicinity of the motion detector.

Although FIG. 1 illustrates one example of a security system 100, the motion detection system 160, anti-masking control system 170, and anti-masking system 180 may be implemented in any appropriate security system environment. The illustrated security system 100 is merely an example of a suitable environment for the system of the invention and is not intended to suggest any limitation as to the scope of use or functionality of the invention. Neither should the security system 100 be interpreted as having any dependency or requirement relating to any one or combination of components illustrated.

Figure 2:
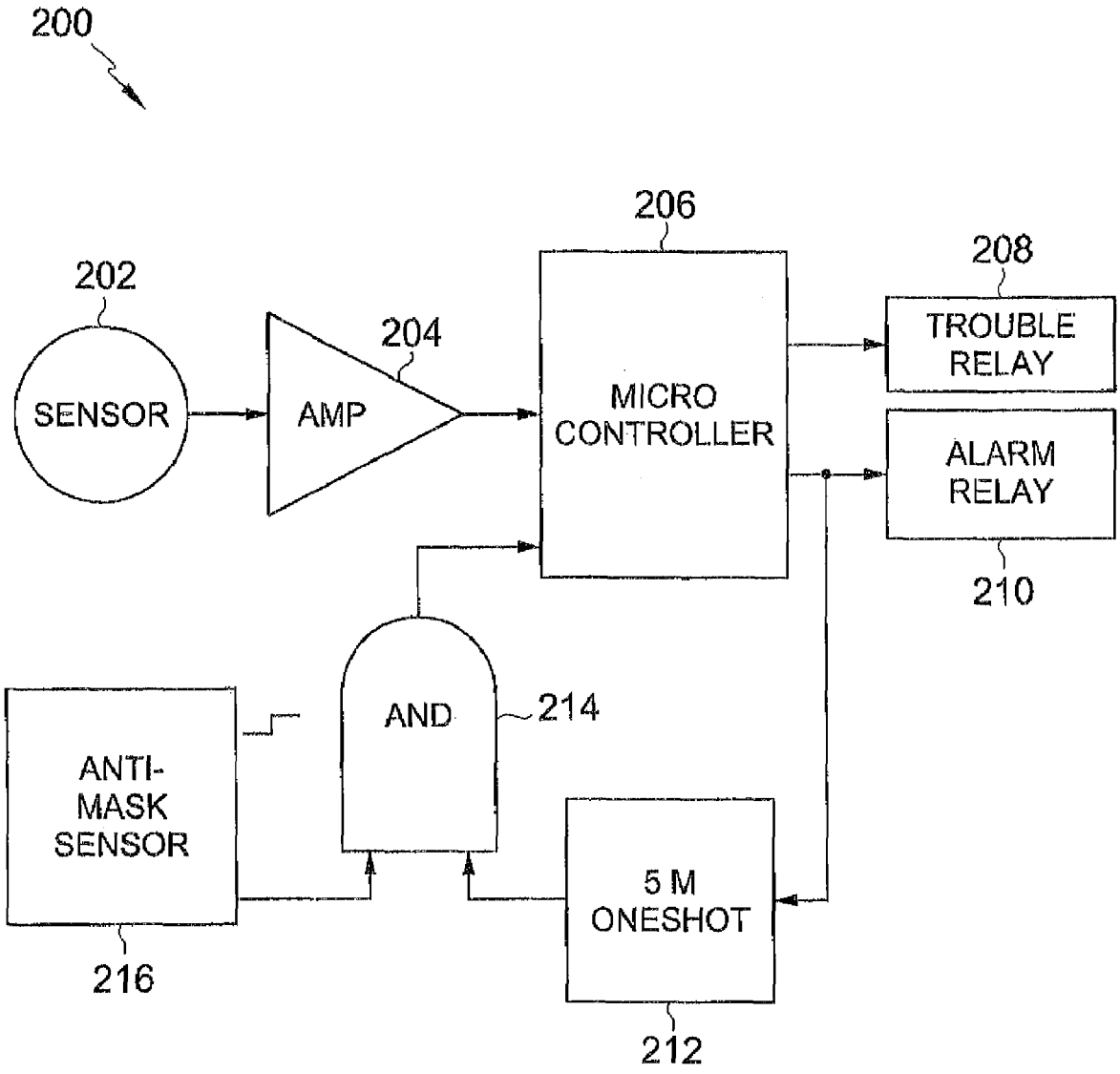
FIG. 2 is circuit a diagram illustrating components of an anti-masking control system in accordance with an embodiment of the invention.

FIG. 2 is a circuit diagram illustrating an embodiment of an anti-masking control system 200. A sensor 202 is preferably an IR sensor that is capable of sensing body heat of an intruder. Although this sensor 202 is shown as a component of the anti-masking control subsystem 200, it may also function as a sensor for the motion detection system. An amplifier 204 amplifies the signal from sensor 204. A microcontroller 206 processes the amplified signal received from the amplifier 204. A trouble relay 208 may be implemented by the anti-masking system when tampering is detected. The microcontroller 206, based on the processing, determines whether to make an alarm decision. When the microcontroller 206 makes an alarm decision, an alarm relay 210 may be activated for a time period, which typically is several seconds. The alarm relay 210 triggers a oneshot 212, i.e. monostable multivibrator. The stable state of the oneshot 212 may be an OFF state and the temporary state may be an ON state during which a single pulse may be generated. Thus, when triggered, the output of the oneshot 212 goes high.

The output of the oneshot 212 is delivered to an AND gate 214 where it may be combined with output from the anti-mask sensor 216. The combined inputs to the AND gate 214 may determine whether a trouble signal will be generated by the trouble relay 208. In this embodiment, the trouble relay 208 will be activated if the anti-mask sensor 216 senses material in its vicinity and if the oneshot 212 is activated.

The oneshot 212 may be continuously re-triggerable through input from the sensor 202, such that it will be re-triggered at each sensing of a human presence. This continual sensing will case the anti-masking system to remain ON or in a high sensitivity or activated state.

However, in some instances, an intruder may be attempting to avoid detection by the anti-masking system. As an added precaution, to account for these situations, the oneshot may include an optional timer, which may be for example a five minute timer. However, the timer may also be activated for other time periods, such as any time period between 1 second and ten minutes. The stable state of the timer 212 is an OFF state and the temporary state is the timing state for the time period as explained above, during which a single pulse may be generated for the specified time period. Thus, when triggered, the output of the oneshot 212 goes high for an extended time period as determined by the timer.

The timer is re-triggerable so that the enable time of the anti-masking signal is extended every time movement is detected. The oneshot timer is used to improve the chances that the antimask system is active when a person is in the room. In most cases the timer is not needed since the person would likely cause continuous alarm activations when attempting to mask the unit. The timer is most useful to guard against the person that knows that the antimask system is not active when the sensor 202 does not detect movement. This would obviously be a highly skilled saboteur.

Thus, in the embodiment illustrated in FIG. 2, the anti-masking sensor 216 is disabled when no human presence has been detected in the room. More particularly, the anti-masking sensor 216 may be enabled for an extended time period, such as for five minutes upon detection of a human presence in the vicinity of the motion detectors.

Figure 3:
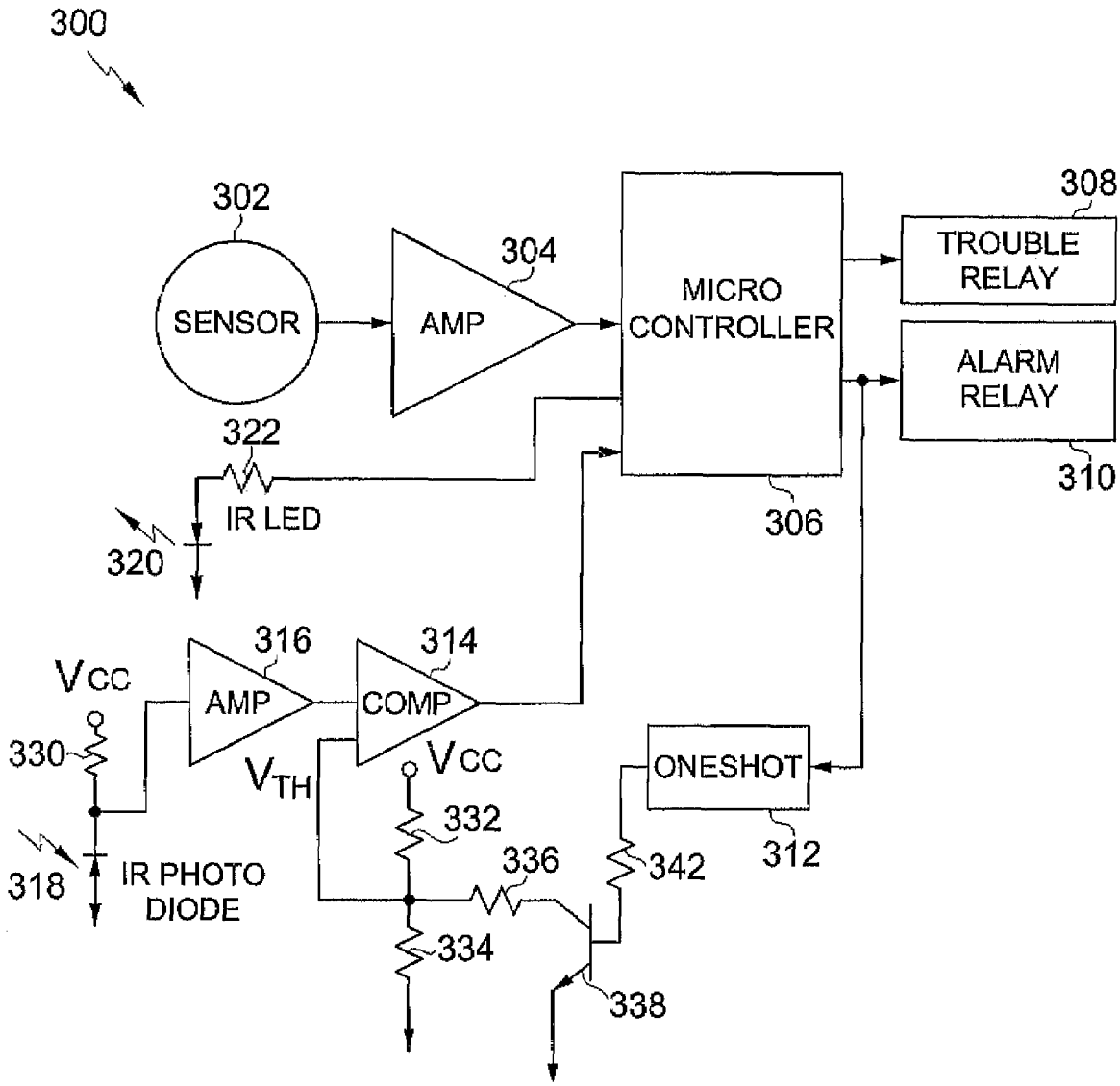
FIG. 3 is a circuit diagram illustrating components of an anti-masking control system in accordance with an alternative embodiment of the invention.

FIG. 3 illustrates an anti-masking control system 300 in accordance with an alternative embodiment of the invention. The circuit may include a sensor 302, amplifiers 304 and 316, a comparator 314, a microcontroller 306, a trouble relay 308, an alarm relay 310, a oneshot 312, and an IR LED 320 and IR photodiode 318 with resistors 322 and 330. The system may additionally include resistors 332, 334, 336, and 342 as well as a transistor 338.

The sensor 302 may sense a human presence. The sensor 302 may be for instance an IR sensor that senses the body heat of an intruder and may be incorporated in the motion detection system. The amplifier 304 amplifies the signal from the sensor 302 and passes the amplified signal to a microcontroller 306. The microcontroller 306 processes the signal and is able to generate output to the alarm relay 310. The alarm relay 310 may be activated based on input from the sensor 302 to trigger the oneshot 312. As in the first embodiment described above, the oneshot 312 may include a timer.

Additional components of the system 300 operate to adjust the threshold sensitivity level. The threshold sensitivity adjustment reduces the possibility of false activation caused by external noise sources.

In order to adjust sensitivity, the exemplary configuration shown includes resistors 332 and 334, which may operate as voltage dividers, resistor 336, and a transistor 338. The resistance values of the aforementioned resistors may be chosen to set a threshold level $V_{TH}$ based on when a trouble indication is desired.

When triggered by the sensing of a human presence, the oneshot 312 sends a signal through resistor 342, which turns on a transistor 338. This shorts one end of the resistor 334 to ground such that the resistors 336 and 334 become parallel and reduce the set threshold $V_{TH}$ and make the system more sensitive. Thus, when the transistor is activated, the system is set at a minimum threshold value and when the transistor is inactive, the system is set at a maximum threshold value.

In order to determine if a trouble signal should be generated based on the set threshold, a voltage is generated based on signals received by an IR photo-diode 318, which operates as an anti-mask detection system along with the IR LED 320. The detection of material close to the detection system results in a signal generated in sensor 318. The sensor 318 senses material within its range and as the material approaches the photodiode, the signal voltage increases. Generally, the closer material is to the IR photodiode 318, the larger the signal. The signal is amplified by the amplifier 316 and forms an input to the comparator 314.

If the signal is higher than the set $V_{TH}$, the system 300 may generate a trouble signal by activating the trouble relay 308. As set forth above, $V_{TH}$ is adjusted dependent on whether the oneshot 312 has been triggered. If the oneshot 312 has been triggered, the voltage $V_{TH}$ has its minimum value. If the oneshot has not been triggered, the voltage $V_{TH}$ has its maximum value.

Thus, in the embodiment of FIG. 3, the anti-masking control system 300 maintains the anti-masking system at a default "low sensitivity" state and activates a higher sensitivity state upon triggering of the oneshot 312. As with the embodiment of FIG. 2, the oneshot 312 may include a timer such that the threshold voltage will be minimized for a predetermined time period.

Thus, the generation of a trouble signal will depend upon a number of factors that may include the threshold set, the power designated by $V_{cc}$, and the signal received. In embodiments of the invention, the power $V_{cc}$ is set to +5Vdc.

The particular embodiments disclosed above are not intended to be limiting, but rather illustrative of hardware and software that may be used for carrying out the objectives of the invention. For instance, although shown as discrete components, the circuitry such as the AND gate of FIG. 2 and the timer of FIGS. 2 and 3 may be incorporated as firmware code in the illustrated microcontroller. Many software solutions are possible.

Figure 4:
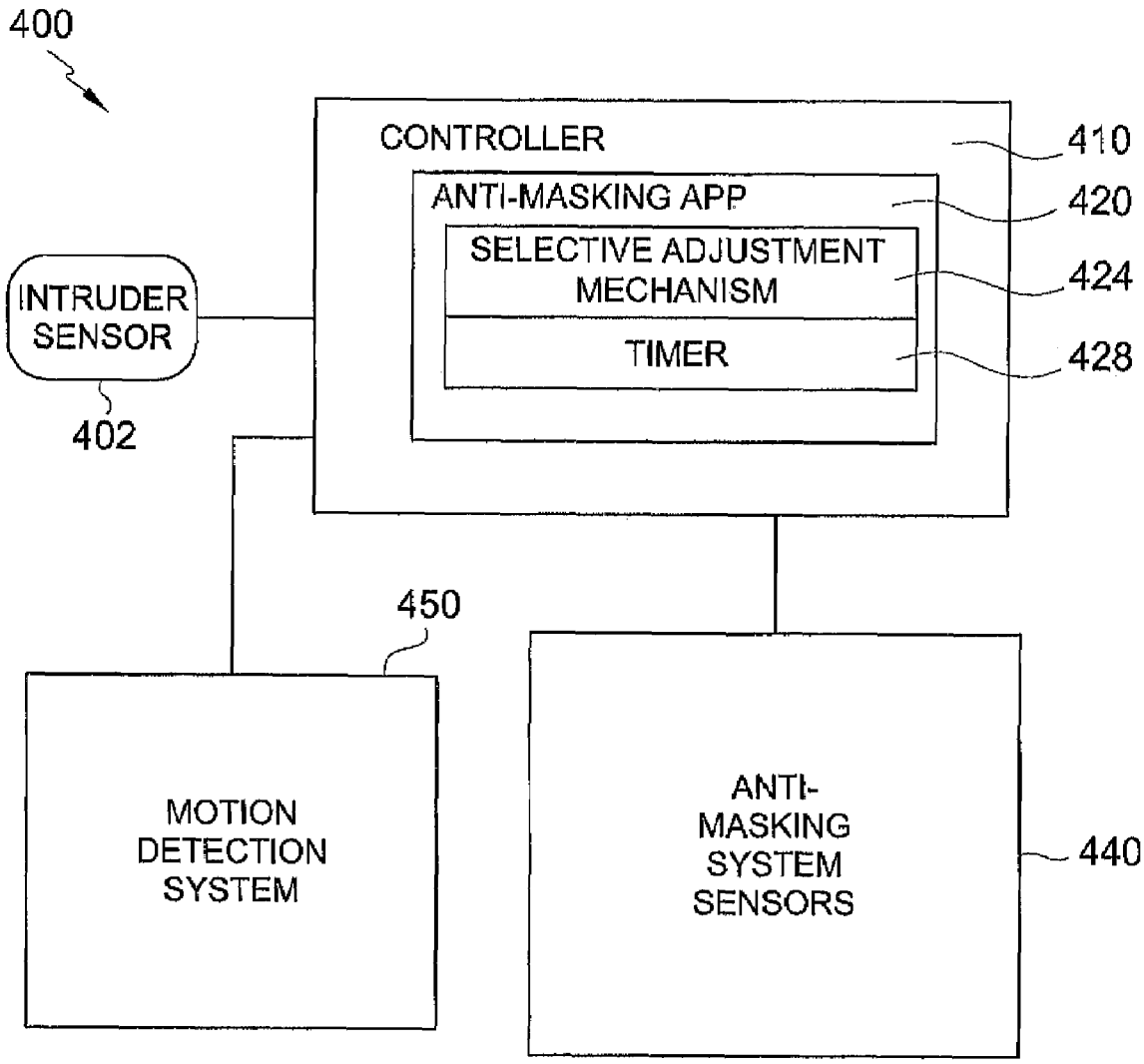
FIG. 4 is a block diagram illustrating an anti-masking control system in accordance with a further embodiment of the invention.

FIG. 4 illustrates an anti-masking control system 400 in accordance with an additional embodiment of the invention. An intruder sensor 402 sends a signal to the controller 410. The intruder sensor 402 may be incorporated in the motion detection system 450. The controller 410 maintains an anti-masking application 420. The anti-masking application 420 may include a selective adjustment mechanism 424, which may be a program module, and a timer or timing application 428. The anti-masking application 420 delivers commands to the anti-masking system sensors 440 in order to enable or disable the anti-masking system or alternatively to increase or reduce the sensitivity of the anti-masking system sensors 440 to a pre-selected level. The motion detection system 450 and other components discussed above may also be connected to the controller 410.

In wireless embodiments of the invention, it may be a goal to maximize battery life. During the anti-mask disable period as described in relation to FIG. 2, or reduced sensitivity period described in relation to FIG. 3, the drive signal to the IR LED may be disabled in order to conserve energy. For example, with reference to FIG. 3, the microcontroller 306 could be programmed to disable a drive signal to the IR LED 320. This modification is particularly easy to implement in a system in which all control functions are located within a microcontroller as firmware. The IR LED may draw a considerable amount of current even when operating in a pulsed mode and many detectors are located in areas where movement is not detected for several consecutive days. Thus, disabling the IR LED when no movement is detected could greatly extend battery life.

Figure 5:
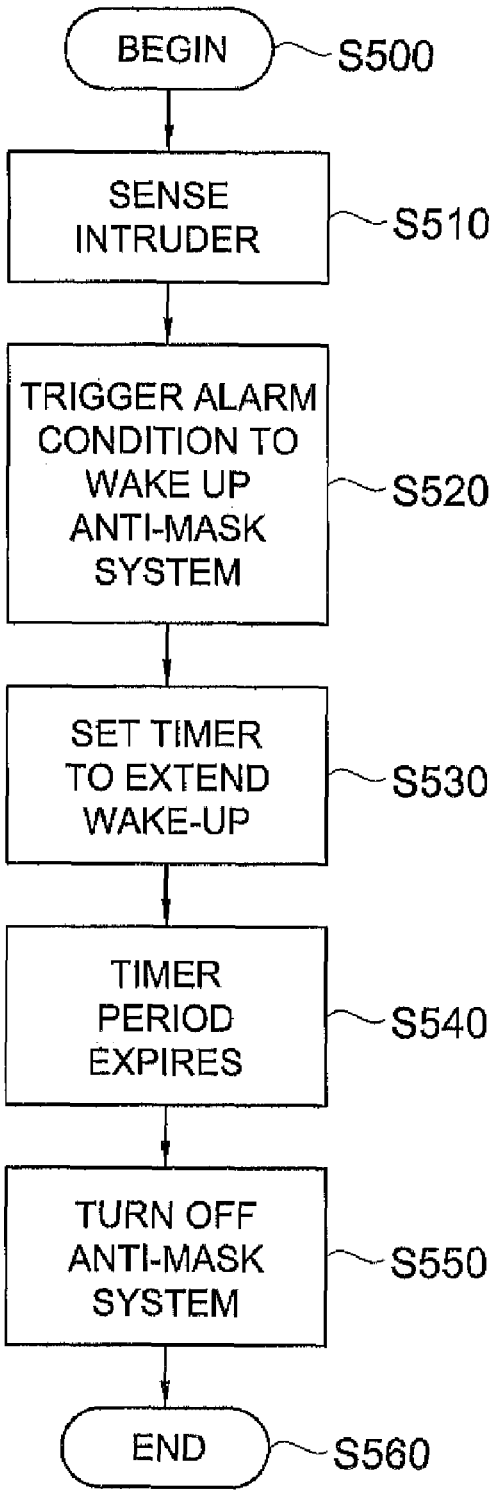
FIG. 5 is flow chart illustrating a method for controlling an anti-masking system in accordance with an embodiment of the invention.

FIG. 5 is a flow chart illustrating a method for controlling an anti-masking system in accordance with an embodiment of the invention. The method begins in S500 and a sensor such as an IR or MW sensor described above, that may be incorporated in the motion detection system, senses an intruder in the vicinity of a motion detection sensor in S510. In S520, the anti-masking control system triggers an alarm condition to wake up the anti-masking system. In S530, the anti-masking control system optionally sets the timer to extend the alert period of the anti-masking system. In S540, the time period expires and in S550, the anti-masking control system may turn off the anti-masking system. The process ends in S560. Of course, the anti-masking control system would repeat S520-S550 anytime an intruder is sensed. Thus, the anti-masking system remains in a sleeping or disabled state and is awakened or enabled when the presence of an intruder is sensed. After a predetermined time period, the anti-masking system returns to the sleeping state and may be re-awakened upon intruder detection.

Figure 6:
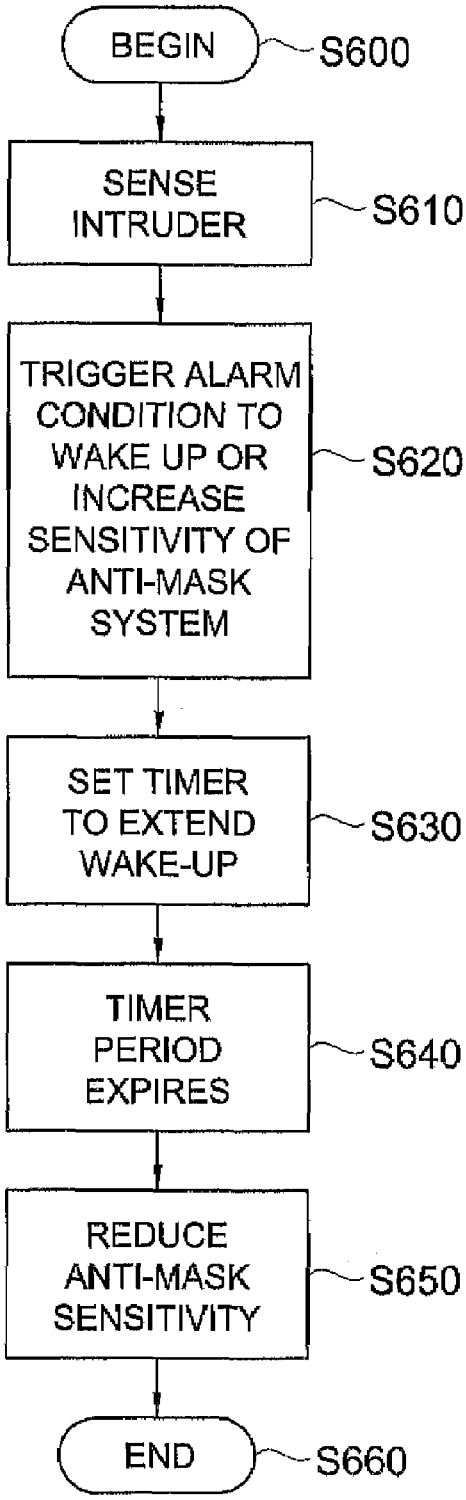
FIG. 6 is a flow chart illustrating a method for controlling an anti-masking system in accordance with another embodiment of the invention.

FIG. 6 illustrates an additional embodiment of a process for controlling an anti-masking system. The process begins in S600 and a sensor such as an IR sensor, which may be incorporated in the motion detection system, senses an intruder in S610. The sensing of an intruder ultimately triggers an alarm condition to wake up the anti-masking system by raising its sensitivity in S620. In S630 the anti-masking control system optionally sets a timer to extend the period of increased sensitivity. In S640, the predetermined time period monitored by the timer expires. In S650, upon expiration of the timer, the anti-masking control system reduces the sensitivity of the anti-masking system in order to minimize false alarms. The process ends in S660. Of course, the anti-masking control system would repeat S620-S650 anytime an intruder is sensed. Thus, the anti-masking system remains in a low sensitivity sleeping state and is awakened to reach a higher sensitivity awake state when the presence of an intruder is sensed. After a predetermined time period, the anti-masking system returns to the sleeping state and may be re-awakened upon intruder detection.

While particular embodiments of the invention have been illustrated and described in detail herein, it should be understood that various changes and modifications might be made to the invention without departing from the scope and intent of the invention.

From the foregoing it will be seen that this invention is one well adapted to attain all the ends and objects set forth above, together with other advantages, which are obvious and inherent to the system and method. It will be understood that certain features and sub-combinations are of utility and may be employed without reference to other features and sub-combinations. This is contemplated and within the scope of the appended claims.

What is claimed is:

1. An anti-masking control system for controlling operation of an anti-masking system that detects tampering with a motion detection system, the control system comprising:

a selective adjustment mechanism for automatically adjusting a sensitivity level of the anti-masking system; and a trigger mechanism for triggering the selective adjustment mechanism upon occurrence of an event to raise the sensitivity level of the anti-masking system.

2. The anti-masking control system of claim 1, further comprising a sensor for sensing a presence and activating the trigger mechanism.

3. The anti-masking control system of claim 2, wherein the sensor detects body heat.

4. The anti-masking control system of claim 2, wherein the sensor comprises at least one of a PIR sensor and a MW sensor for sensing the presence.

5. The anti-masking control system of claim 1, further comprising a timer for extending the raised sensitivity level for a predetermined time period.

6. The anti-masking control system of claim 5, wherein the predetermined time period is between 2 minutes and 8 minutes.

7. The anti-masking control system of claim 1, wherein an initial sensitivity level is a disabled state and a triggered sensitivity level is an enabled state.

8. The anti-masking control system of claim 1, wherein an initial sensitivity level is a monitoring state having a lower sensitivity level than the triggered sensitivity level.

9. A motion detection system comprising:

at least one motion detection sensor for detecting motion;

an anti-masking system for preventing tampering with the at least one motion detection sensor;

an anti-masking control system for minimizing false alarms of the anti-masking system by selectively altering a sensitivity of the anti-masking system;

a trigger mechanism for receiving output from the sensor; and a selective adjustment mechanism for automatically adjusting a sensitivity level of the anti-masking system in response to an output from the trigger mechanism indicating detection of a presence by the at least one motion detection sensor.

10. The motion detection system of claim 9, wherein the sensor detects body heat.

11. The motion detection system of claim 9, wherein the sensor comprises at least one of a PIR sensor and a MW sensor for sensing a presence.

12. The motion detection system of claim 9, further comprising a timer for extending the adjusted sensitively level for a predetermined time period.

13. The motion detection system of claim 12, wherein the predetermined time period is between 2 minutes and 8 minutes.

14. The motion detection system of claim 9, wherein an initial sensitivity level is a disabled state and an adjusted sensitivity level is an enabled state.

15. The motion detection system of claim 9, wherein an initial sensitivity level is a monitoring state having a lower sensitivity level than an adjusted sensitivity level.

16. The motion detection system of claim 9, wherein the anti-masking system comprises an IR LED and the anti-masking control system disables a drive signal to the IR LED during a period of low sensitivity.

17. A method for minimizing false alarms in an anti-masking system designed to prevent tampering with a motion detection system, the method comprising:

implementing a sensor to detect a presence;

activating a trigger mechanism upon detection of the presence;

selectively adjusting a sensitivity level of the anti-masking system automatically in response to the detection of the presence.

18. The method of claim 17, further comprising activating a timer for extending the adjusted sensitively level for a predetermined time period.

19. The method of claim 17, further comprising implementing the sensor to detect body heat.

20. The method of claim 17, wherein the step of implementing a sensor to detect a presence comprises providing at least one of a PIR sensor and a MW sensor for sensing the presence.

21. The method of claim 18, further comprising adjusting the predetermined time period to between 2 minutes and 8 minutes.

22. The method of claim 18, further comprising setting an initial sensitivity level to a disabled state and adjusting the sensitivity level to an enabled state.

23. The method of claim 18, further comprising setting an initial sensitivity level to a monitoring state and adjusting the sensitivity level to a higher sensitivity monitoring state.

24. A computer readable medium comprising computer executable instructions for performing the method of claim 16.

* * * * *